US005666850A

United States Patent [19]

Yanagisawa et al.

[11] Patent Number: 5,666,850

[45] Date of Patent: Sep. 16, 1997

[54] MOTOR-OPERATED PRESS MECHANISM

[75] Inventors: Kunikazu Yanagisawa; Shin Ando, both of Nagano, Japan

[73] Assignee: APIC Yamada Corporation, Nagano, Japan

[21] Appl. No.: 560,687

[22] Filed: Nov. 20, 1995

[30] Foreign Application Priority Data

Nov. 29, 1994 [JP] Japan ..... 6-294753

[51] Int. Cl.[6] ..... B21J 9/18

[52] U.S. Cl. ..... 72/450; 72/452.5

[58] Field of Search ..... 72/450, 452.5

[56] References Cited

U.S. PATENT DOCUMENTS

| | | | |
|---|---|---|---|
| 1,956,658 | 5/1934 | Schmidt . | |
| 3,318,762 | 5/1967 | Daniele et al. . | |
| 3,908,434 | 9/1975 | Ribback | 72/452.5 |
| 4,034,666 | 7/1977 | Bigun et al. . | |
| 4,229,963 | 10/1980 | Savinov et al. | 72/452.5 |
| 5,408,860 | 4/1995 | Bair et al. | 72/450 |
| 5,477,725 | 12/1995 | Muller | 72/450 |

FOREIGN PATENT DOCUMENTS

| | | | |
|---|---|---|---|
| B448628 | 5/1974 | Australia . | |
| 0569603 | 11/1993 | European Pat. Off. . | |
| 3-216296 | 9/1991 | Japan | B30B 1/26 |
| 4-157098 | 5/1992 | Japan | B30B 15/06 |
| 5-123900 | 5/1993 | Japan | B30B 15/06 |
| A573132 | 11/1945 | United Kingdom . | |

*Primary Examiner*—David Jones

*Attorney, Agent, or Firm*—Sughrue, Mion, Zinn, Macpeak & Seas

[57] ABSTRACT

In a motor-operated press mechanism, a rocking link is rockingly supported by a supporting shaft which is pivotally supported by a top plate of a press machine, while a crank shaft which supports a crank is supported on one end portion of the rocking link, and a drive section is provided on another end portion of the rocking link, which, in a press working operation, regulates the position of the rocking link so that the crank shaft, the supporting shaft, and the press ram are substantially on a straight line, and, in a resetting operation, swings the rocking link so that the press ram is moved to a retracting position above the position where it is located in the press working operation.

6 Claims, 3 Drawing Sheets

MOTOR-OPERATED PRESS MECHANISM

BACKGROUND OF THE INVENTION

1. Field of the Invention

This invention relates to motor-operated press mechanisms, and more particularly to a motor-operated press mechanism which makes it possible to perform both a press working operation with an ordinary stroke and a die opening operation, for instance, in replacing a working die, and which is capable of adjusting the bottom dead center of the press ram.

2. Description of the Related Art

In the case where, in a motor-operated press machine of the crank press type, for instance the working die is replaced, it is necessary to adjust the bottom dead center of the press ram so as to obtain a predetermined working accuracy. The bottom dead center of the press ram is adjusted as follows: In an example of the bottom dead center adjustment method, a vertical movement shaft is threadably coupled to a slide, and the former is turned with respect to the latter, so that the slide is threadably adjusted in height (see Japanese Patent Unexamined Publication No. Hei 5-123900). In another example of the method, a crank shaft is variable in eccentric position, so that the adjustment is achieved by adjusting the amount of eccentricity (see Japanese Patent Unexamined Publication No. Hei 3-216296). In still another example of the method, the adjustment is achieved by changing the position of the fulcrum of a rocker arm adapted to push the ram (see Japanese Patent Unexamined Publication No. Hei 4-157098).

In the case where, in an ordinary press machine, its working metal mold is replaced, an upper die is removed from the press ram, and then the press ram is moved above so as not to obstruct the metal mold replacing operation; that is, the metal mold is replaced after the press ram has been retracted above. In a motor-operated press machine, the range of stroke of the press ram depends on the range of movement of the eccentric shaft of the crank. Hence, the range of stroke of the press ram is set to a relatively large value, and the metal mold is replaced after the press ram is moved to its uppermost position.

However, in a conventional motor-operated press machine, the range of stroke is set as required for a given press working operation. Hence, in replacement of the metal mold or during maintenance, the die opening operation cannot be readily achieved. In addition, the motor-operated press machine suffers from a difficulty that, in the case where the bottom dead center of the press ram is to be finely adjusted, the range of adjustment is small, and therefore the adjustment cannot be readily achieved.

Furthermore, the use of the motor-operated press machine of the type in which no clutch brake is used gives rise to another problem. That is, in the case where trouble occurs during press working—for instance a workpiece is erroneously fed to damage the die, it is impossible to stop the press machine immediately thereby to prevent the die from damage. That is, when such trouble occurs during press working, the press machine should be stopped without delay to eliminate the trouble. However, the inertia of the press ram or the like makes it impossible to stop the press machine immediately. In a resetting operation after the occurrence of jamming, correction cannot be manually made for the die, that is, it is impossible to put the operator's hand between the dies, with the result that the resetting operation takes time.

SUMMARY OF THE INVENTION

Accordingly, the invention has been made to eliminate the above-described difficulties accompanying a conventional motor-operated press machine, and therefore an object of the invention is to provide a motor-operated press mechanism which is advantageous in that a press working operation with an ordinary range of stroke can be efficiently performed, and in a resetting operation after the occurrence of jamming, a die opening operation can be readily conducted, and that, during press working, trouble can be readily eliminated if any, and the bottom dead center of the press ram can be readily adjusted, and which can be handled with ease.

The foregoing object of the invention has been achieved by the provision of a motor-operated press mechanism, comprising:

an electric motor;

a crank which is rotatably driven by said electric motor;

a press ram coupled to said crank so as to be reciprocated vertically;

a top plate;

a supporting shaft mounted on said top plate;

a rocking link rockingly supported by said supporting shaft;

a crank shaft supporting said crank and supported on one end portion of said rocking link; and a drive section provided on another end portion of said rocking link;

wherein, in a press working operation, said drive section regulates the position of said rocking link so that said crank shaft, said supporting shaft and said press ram are substantially on a straight line, and in a resetting operation, said drive section swings said rocking link so that said press ram is moved to a retracting position above a position where said press ram is located in the press working operation.

In the motor-operated press mechanism, a stopper may be provided which projects horizontally and inwardly from a side wall of a casing proximate to said drive section, and a side surface of said rocking link abuts against said stopper to regulate the position of said rocking link in the press working operation, wherein said drive section energizes the rocking link so that the side surface of said rocking link is abutted against said stopper. Hence, in the ordinary press working operation, the position of the rocking link can be positively held unchanged.

Furthermore, in the motor-operated press mechanism, the regulating position determined by said stopper in the ordinary press working operation may be angularly shifted from the position where said crank shaft is placed substantially on a straight line together with said supporting shaft and said press ram by said rocking link. This feature prevents the rocking link from being rocked by a resiliency applied to the press ram.

Moreover, in the motor-operated press mechanism, said stopper may be provided with an adjusting mechanism which adjusts the amount of protrusion of said stopper, to thereby finely adjust the bottom dead center of said press ram.

In addition, in the motor-operated press mechanism, an air cylinder may be employed as said drive section, so that said rocking link is kept urged at all times. Hence, the rocking link can be swung with ease.

In the ordinary press working operation in which the press ram is moved up and down, the rocking link is set by the drive section so that the crank shaft, the supporting shaft and the press ram are substantially on a straight line. When the crank shaft, the supporting shaft and the press ram are positioned substantially on a straight line as was described above, no unreasonable force is applied to the rocking link, and therefore the press working operation is smoothly achieved. In the resetting operation after jamming, or in case of trouble during press working, the drive section swings the rocking link to move the press ram upwardly beyond the range of stroke in the ordinary press working operation. More specifically, the press ram is moved upwardly to the position where it will not obstruct, for instance, the replacement of the die. In case of an emergency such as the occurrence of trouble, the apparatus is stopped, and the rocking link is swung to forcibly move the press ram upwardly, thereby to avoid the effect of the inertia of the press ram to thereby eliminate the trouble.

The bottom dead center of the press ram is adjusted by adjusting the set position of the rocking link in an ordinary press working operation; that is, by adjusting the height of the crank shaft.

The nature, utility and principle of the invention will be more clearly understood from the following detailed description and the appended claim when read in conjunction with the accompanying drawings.

DETAILED DESCRIPTION OF THE PREFERRED EMBODIMENTS

The invention will be described with reference to its preferred embodiment shown in the accompanying drawings.

Figure 1:
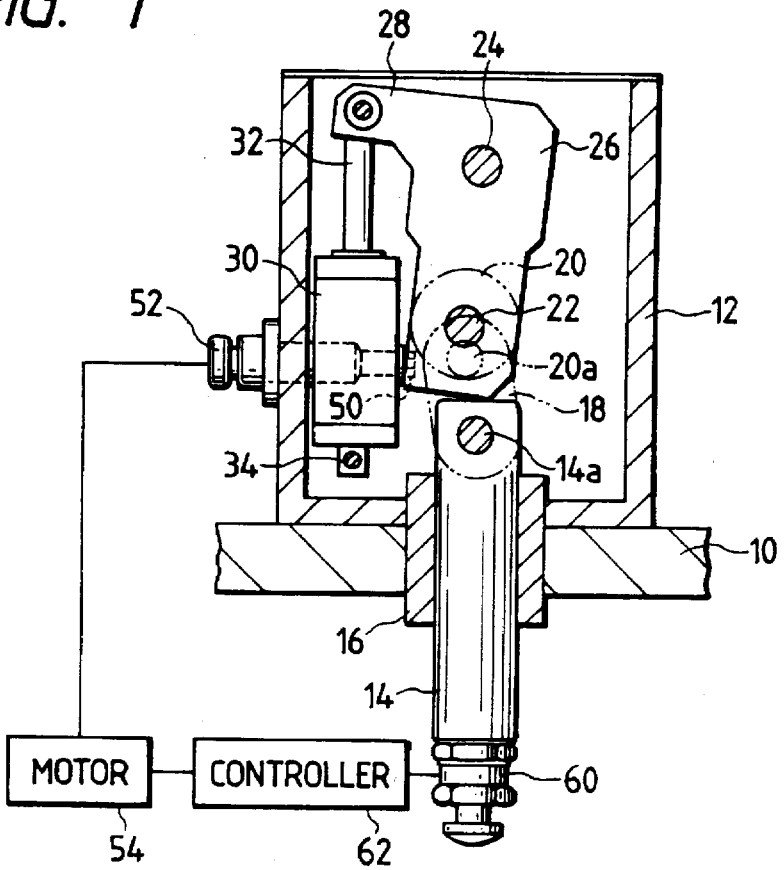
FIG. 1 is an explanatory diagram showing the arrangement of essential components of a motor-operated press mechanism according to the invention when a press working operation is carried out with an ordinary stroke.
Figure 2:
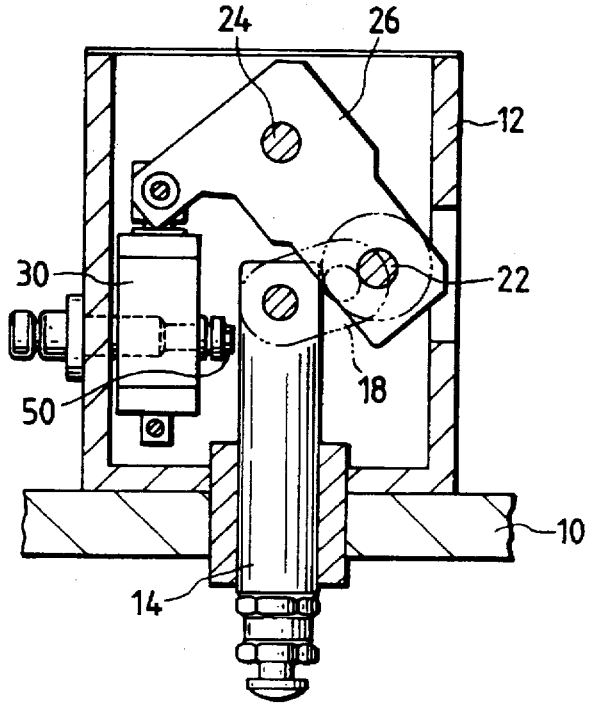
FIG. 2 is also an explanatory diagram showing the arrangement of essential components of the motor-operated press mechanism with a press ram moved upwardly to a retracting position.

FIGS. 1 and 2 are explanatory diagrams for a description of the arrangement of essential components of a motor-operated press mechanism, which constitutes the embodiment of the invention. In FIGS. 1 and 2, reference numeral 10 designates a top plate of the motor-operated press mechanism; 12, a casing which sealingly accommodates a drive section of the press mechanism; and 14, a press ram which is extended downwardly of the top plate 10 being guided by a slide guide 16.

Further, in FIGS. 1 and 2, reference numeral 18 designates a connecting rod through which the press ram 14 is coupled to a crank 20. One end portion of the connecting rod 18 is rotatably mounted on a shaft **14*a* extended from the upper portion of the press ram 14, and the other end portion is rotatably mounted on an eccentric shaft 20*a* of the crank 20, so that the rotational motion of the crank 20 is converted into the vertical motion of the press ram 14. The vertical stroke of the press ram 14 depends on the rotational stroke of the eccentric shaft 20*a* of the crank 20**.

In an ordinary motor-operated press machine, the crank shaft 22 of a crank 20 is supported on the body of the motor-operated press machine, and turned by the output shaft of the motor. On the other hand, in the motor-operated press mechanism of the invention, the crank shaft 22 is rockingly provided. This is one of the features of the motor-operated press mechanism of the invention. That is, a supporting shaft 24 is rotatably mounted on the casing 12, and a rocking link 26 is mounted on the supporting shaft 24 in such a manner that it is rockingly in a vertical plane. The crank shaft 22 is mounted on the rocking link 26, thus being rockable together with the latter.

More specifically, the crank shaft 22, as shown in FIG. 1, is mounted on the lower end portion of the rocking link 26 below the supporting shaft 24, and therefore it is also rockable.

Figure 3:
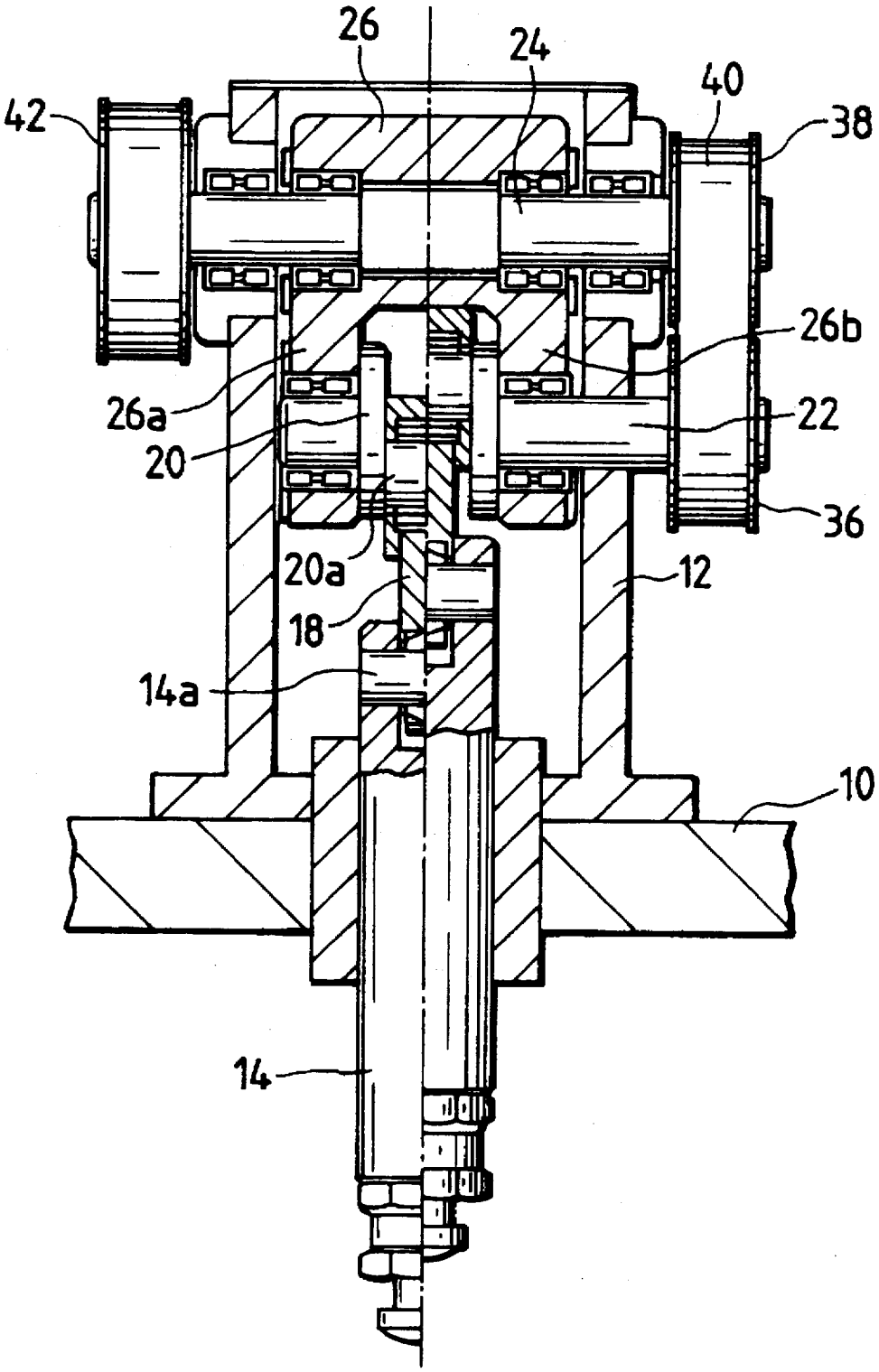
FIG. 3 is an explanatory diagram for a description of the operation of a press ram when a press working operation is carried out with an ordinary stroke.

FIG. 3 is a sectional view of the rocking link 26 and the crank shaft 22 as viewed from the front. The supporting shaft 24 is held horizontal between both side frames of the casing 12. The rocking link 26 embraces the crank 20 from both sides, having a pair of supporting arms **26*a* and 26*b* which support the crank shaft 22. As was described above, the crank shaft 22 is supported by the supporting arms 26*a* and 26*b* of the rocking link 26. Hence, as the rocking link 26 rocks about the supporting shaft 24, the crank shaft 22 is swung about the supporting shaft 24**.

Figure 4:
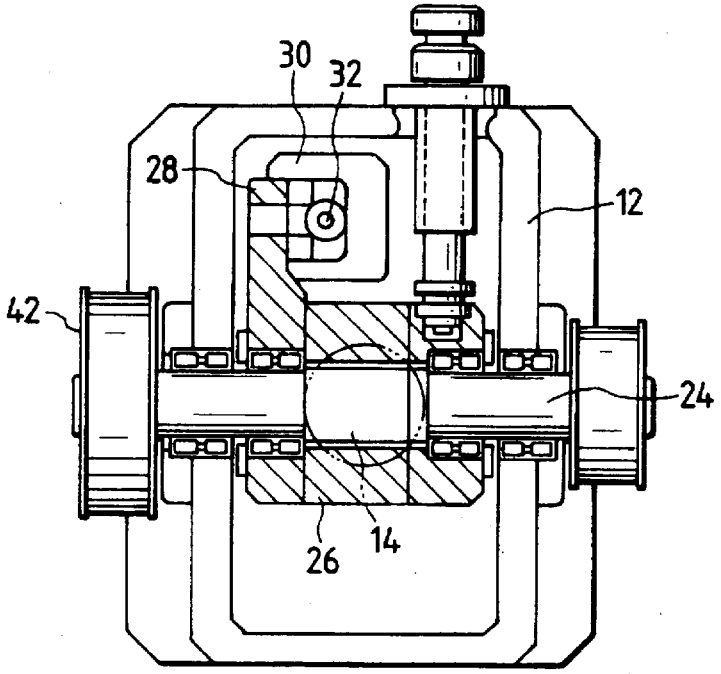
FIG. 4 is an explanatory diagram showing the arrangement of a rocking link and an air cylinder in the motor-operated press mechanism.

The rocking link 26 includes a swing arm 28 which is extended substantially horizontally of the supporting shaft 24. The end portion of the swing arm 28 is engaged with the driving rod 32 of a drive section, namely, an air cylinder 30. The air cylinder 30 operates not only to position the rocking link 26 at the ordinary press working position, but also to swing the rocking link 26 thereby to retract the press ram 14 upwardly to a predetermined retracting position. The air cylinder 30 is so arranged that it is able to move its driving rod 31 up and down, and it is swingable about a shaft 34 in a vertical plane with its lower end portion pivotally engaged with the latter 34. FIG. 4 is a plan view showing the arrangement of the rocking link 26 and the air cylinder 30.

The air cylinder 30 operates to push the swing arm 28 of the rocking link 26. Instead of the air cylinder, an electric motor may be employed as the drive section.

Figure 5:
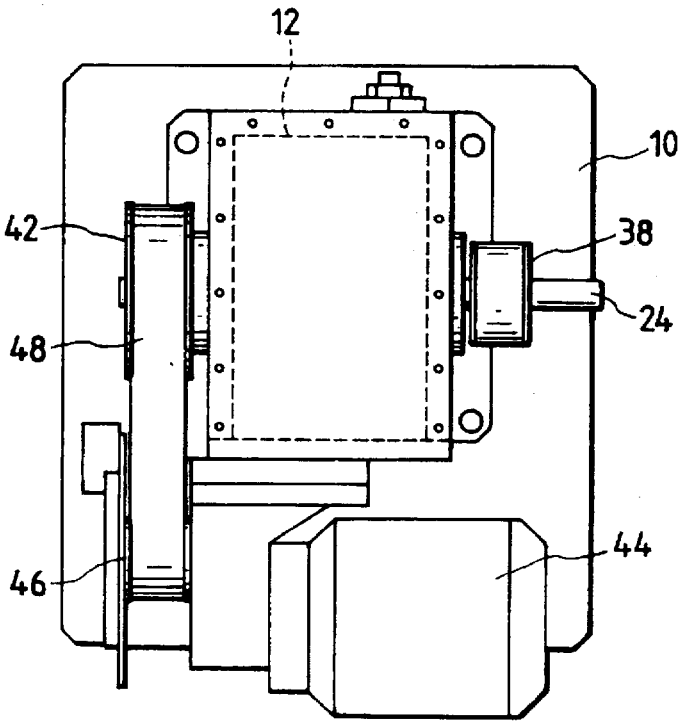
FIG. 5 is a plan view showing an electric motor, a casing, etc. of the motor-operated press mechanism of the invention.

A drive system for moving the press ram 14 vertically is designed as follows: That is, as shown in FIG. 3, an endless belt 40 is laid over a pulley 36 which is mounted on the crank shaft 22 and a pulley 38 which is mounted on one end portion of the supporting shaft 24, respectively; and as shown in FIG. 5 an endless belt 48 is laid over a pulley 42 mounted on the other end portion of the supporting shaft 24 and a pulley 46 mounted on the output shaft of an electric motor 44. Thus, the torque of the motor 44 is transmitted to the crank 20 to drive the press ram 14.

FIG. 1 shows a state of the motor-operated press mechanism that the rocking link 26 is at the lower position, and an ordinary press working operation is carried out with the press ram 14. FIG. 3 shows how the press ram 14 is moved up and down. More specifically, the left half of FIG. 3 shows the press ram 14 which is moved downwardly; and the right half of FIG. 3 shows the press ram 14 which is moved upwardly. As the crank 20 is turned through the above-described drive system by the motor 44, the press ram 14 is moved up and down.

In FIG. 1, the set position of the rocking link 26 is such that the supporting arms which support the crank shaft 22 are somewhat angularly shifted from their lowest position. This is due to the fact that the swing arm 28 is held pushed upwardly by the air cylinder 30, to urge the rocking link 26 clockwise at all times, and the rocking link 26 is so positioned by a stopper 50 (described later) that it is slightly shifted from its lowest position. The stopper 50 abuts against the side surface of the rocking link 26, to regulate the position of the latter 26.

The reason why the position of the rocking link 26 is set as described above, is to prevent the rocking link 26 from being swung right by a resiliency applied to the press ram 14 during press working. This will be described in more detail. The air cylinder 30 applies a force to the rocking link 26 at all times so that the latter 26 abuts against the stopper 50. However, the fact that the set position of the rocking link 26 is slightly shifted from its lowest position as was described above has the following effect: That is, when resiliency is applied to the press ram 14, torque is applied to the rocking link 26 to cause the latter 26 to abut against the stopper 50, which positively prevents the rocking link 26 from swinging right.

In the case of an ordinary press working operation, the set position of the rocking link 26 is substantially near its lowest position, being slightly shifted from the latter. Hence, the resiliency is linearly applied to the press ram 14. Therefore, during an ordinary press working operation, no unreasonable force is applied to the rocking link 26.

On the other hand, the stopper 50 is so arranged as to positively support the rocking link 26 during press working. In addition, the bottom dead center of the press ram 14 can be adjusted by changing the amount of protrusion of the stopper 50.

In FIG. 1, reference numeral 52 designates an adjusting knob for adjusting the amount of protrusion of the stopper 50. The knob 52 is provided outside the casing 12. For instance in a resetting operation after jamming, the bottom dead center can be readily adjusted by turning the adjusting knob 52.

The stopper 50 may be designed as follows: As shown in FIG. 1, a load cell 60 is provided in the press ram 14 so as to detect a pressure applied thereto, and a controller 62 controls a pulse motor or servo motor 54 in accordance with a detection signal from the load cell 60 to thereby automatically adjust the amount of protrusion of the stopper 50.

FIG. 2 shows another state of the motor-operated press mechanism that the press ram 14 is moved above the range of stroke in the ordinary press working operation. The press ram 14 is moved to the upper position in the above-described manner when trouble occurs during an ordinary press working operation, and it is necessary to stop the operation without delay, or when, in a resetting operation after jamming, it is required to move the press ram 14 away so that the latter my not obstruct the operation.

In the case where trouble occurs which may damage the die—for instance a workpiece is erroneously fed during press working, the air cylinder 30 is immediately stopped, and the rocking link 26 is turned counterclockwise, so that the press ram 14 is moved upwardly to its retracting position located above its ordinary working position. The press ram 14 has a certain inertia; however, it can be retracted instantaneously against the inertia by forcibly moving it away from the working position in the above-described manner.

The displacement of the press ram 14 to the retracting position above the ordinary press working position facilitates the resetting operation after jamming. In the embodiment, the press ram 14 can be readily set at the retracting position by turning the rocking link 26 with the air cylinder; that is, the press ram 14 can be moved without delay, and can be handled with ease. Thereafter, the press ram 14 can be set back to the ordinary press working position readily and quickly.

The rocking link 26 may be swung after the rotation of the crank is stopped in the press working operation; or it may be swung without stoppage of the crank.

As was described above, the mechanism for the stroke movement of the press ram 14 at the ordinary press working position, and the mechanism for displacing the press ram 14 to the retracting position are provided separately. Hence, in the ordinary press working operation, the press ram performs the stroke movement as required for the operation, which effectively improves the work efficiency of the apparatus. In addition, the range of stroke may be small, and therefore the output of the motor for turning the crank may be small.

In the embodiment, the motor 44 is turned in one direction. Hence, the embodiment may be so modified that the driving force of the motor 44 is utilized to operate a workpiece conveying system.

As was described above, in the motor-operated press mechanism of the invention, the crank shaft is made swingable being supported on the rocking link. The press working operation with the ordinary stroke, and the die opening operation, for instance, for replacement of the die can be readily switched over to each other. Thus, the ordinary press working operation, and other operations such as a die opening operation can be readily achieved. In the case where trouble occurs during press working, it can be suitably eliminated by swinging the rocking link. In addition, the bottom dead center of the press ram can be readily adjusted. That is, the motor-operated press mechanism of the invention can be readily handled.

While there has been described in connection with the preferred embodiment of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A motor-operated press mechanism, comprising:

an electric motor;

a crank which is rotatably driven by said electric motor;

a press ram coupled to said crank so as to be reciprocated vertically;

a top plate;

a supporting shaft mounted on said top plate;

a rocking link rockingly supported by said supporting shaft;

a crank shaft supporting said crank and supported on one end portion of said rocking link; and a drive section provided on another end portion of said rocking link;

wherein, in a press working operation, said drive section regulates the position of said rocking link so that said crank shaft, said supporting shaft and said press ram are substantially on a straight line, and in a resetting operation, said drive section swings said rocking link so that said press ram is moved to a retracting position above a position where said press ram is located in the press working operation.

2. A motor-operated press mechanism as claimed in claim 1, further comprising a casing which sealingly accomodates said drive section; a stopper which projects horizontally and inwardly from a side wall of said casing proximate to said drive section; and a side surface of said rocking link which abuts against said stopper to regulate the position of said rocking link in the press working operation, wherein said drive section energizes said rocking link so that said side surface of said rocking link is abutted against said stopper.

3. A motor-operated press mechanism as claimed in claim 2, wherein a regulating position determined by said stopper in the press working operation is angularly shifted from a position where said crank shaft is placed substantially on a straight line together with said supporting shaft and said press ram by said rocking link.

4. A motor-operated press mechanism as claimed in claim 2, wherein said stopper is provided with an adjusting mechanism which adjusts the amount of protrusion of said stopper to finely adjust a bottom dead center of said press ram.

5. A motor-operated press mechanism as claimed in claim 4, wherein said adjusting mechanism comprises a load cell provided in said press ram to detect a pressure applied to said press ram to output a detection signal; a controller for producing a control signal according to the detection signal from said load cell; and a motor connected to said adjusting mechanism for adjusting the amount of protrusion of said stopper according to the control signal from said controller.

6. A motor-operated press mechanism as claimed in claim 1, wherein said drive section comprises an air cylinder.

* * * * *